US012305665B2

(12) United States Patent
Lee

(10) Patent No.: US 12,305,665 B2
(45) Date of Patent: May 20, 2025

(54) VISCOUS FLOW BLOWER

(71) Applicant: GRANDVANCE TECHNOLOGY, INC., Taoyuan (TW)

(72) Inventor: Che-Wei Lee, Taoyuan (TW)

(73) Assignee: GRANDVANCE TECHNOLOGY, INC., Taoyuan (TW)

( * ) Notice: Subject to any disclaimer, the term of this patent is extended or adjusted under 35 U.S.C. 154(b) by 0 days.

(21) Appl. No.: 18/803,687

(22) Filed: Aug. 13, 2024

(65) Prior Publication Data

US 2025/0059979 A1 Feb. 20, 2025

(30) Foreign Application Priority Data

Aug. 17, 2023 (TW) ..... 112130925

(51) Int. Cl.
*F04D 17/08* (2006.01)
*F04D 29/42* (2006.01)

(52) U.S. Cl.
CPC ..... *F04D 29/4206* (2013.01); *F04D 17/08* (2013.01)

(58) Field of Classification Search
CPC .. F04D 29/4206; F04D 29/584; F04D 29/288; F04D 29/281; F04D 17/08; F04D 17/161; F04D 25/08; G06F 1/20; G06F 1/203
See application file for complete search history.

(56) References Cited

U.S. PATENT DOCUMENTS

| | | | | |
|---|---|---|---|---|
| 10,503,220 | B2 | 12/2019 | Delano et al. | |
| 10,920,790 | B2 * | 2/2021 | Chen | F04D 17/161 |
| 11,209,019 | B2 * | 12/2021 | Chen | F04D 17/161 |
| 11,512,708 | B1 * | 11/2022 | Chen | F04D 29/281 |
| 2005/0019154 | A1 * | 1/2005 | Dial | F01D 1/36 415/90 |
| 2010/0242516 | A1 * | 9/2010 | Seo | F28C 1/16 165/96 |
| 2017/0300094 | A1 * | 10/2017 | Delano | F04D 25/08 |
| 2017/0356463 | A1 * | 12/2017 | Hino | F04D 29/626 |
| 2017/0356466 | A1 * | 12/2017 | Hino | F04D 25/0613 |
| 2017/0356467 | A1 * | 12/2017 | Hino | F04D 25/0613 |

* cited by examiner

*Primary Examiner* — Dapinder Singh
(74) *Attorney, Agent, or Firm* — Cheng-Ju Chiang

(57) ABSTRACT

A viscous flow blower includes a housing including an inlet, an outlet, a motor, and an internal space; a seat secured to the housing and including N supporting projections and an axis of rotation. N is an integer equal to or greater than five. The connection member is coaxial with the axis of rotation. The motor is operatively connected to the seat so that the seat can be rotated by activating the motor. Annular blades are stacked on the seat. The blade includes a plurality of through holes with the supporting projections inserted through and secured thereto respectively. The N supporting projections are spaced from the axis of rotation by a predetermine distance. There are N angles formed by the supporting projections. The N angles all have different degrees. It can reduce suddenly sharp increases in amplitude of noise at certain frequencies.

4 Claims, 11 Drawing Sheets

VISCOUS FLOW BLOWER

FIELD OF THE INVENTION

The invention relates to viscous flow blower and more particularly to a viscous flow blower having different angles formed by supporting projections for reducing a suddenly sharp increase in amplitude of noise, being easy to implement, and having a low manufacturing cost.

BACKGROUND OF THE INVENTION

Many different types of conventional viscous flow blowers are disclosed. For example, U.S. patent Ser. No. 10/503,220, entitled "viscous flow blower for thermal management of an electronic device" discloses a fan assembly including a shaft and a plurality of discs positioned along and fixed to the shaft. In operation, a flow (e.g., air) between two adjacent discs moves outward to form an airflow due to centrifugal force, thereby moving heat generated by an internal heat generating component out of a housing. The blower operates the same as a conventional fan for cooling purpose. Thus, it is applicable to transfer heat generated by an electronic device to a fluid medium (e.g., air).

Referring to FIGS. 8, 9 and 10, U.S. patent Ser. No. 10/920,790, entitled "fan" discloses a fan comprising a frame 91, a motor 92, an impeller 93, and a plurality of annular blades 94 secured onto the impeller 93. The motor 92 may rotate the impeller 93, thereby forming an airflow 81 (see arrows in FIG. 8). The airflow 81 radially flows from any two adjacent blades 94 for heat removal. As shown in FIG. 9, the blade 94 includes a plurality of spaced through holes 941, a plurality of spaced supporting projections 96 provided on the impeller 93, and the supporting projections 96 inserted through the through holes 941 of one blade 94 and a plurality of spacers 95 into an adjacent blade 94 to fasten the two blades 94 together.

However, the supporting projections 96 are equally spaced apart on the impeller 93 (see FIG. 10). The number of angles A is five when the number of the supporting projections 96 is five and thus the angle A is 72 degrees (that is, 360/5=72). Substantially, the equally spaced apart supporting projection 96 is advantageous in terms of manufacture and assembly of the fan. Peripheries of hollowed portions of the blades 94 have the same length due to the equally spaced apart supporting projection 96. However, the fan makes noise. In particular, the levels of noise may suddenly sharply increase at certain frequencies possibly due to, for example resonance. This is undesired for some products which require low level of noise in operation.

Thus, the need for improvement still exists.

SUMMARY OF THE INVENTION

It is therefore one object of the invention to provide a viscous flow blower having advantages including different angles formed by supporting projections for reducing a suddenly sharp increase in amplitude of noise, being easy to implement, and having a low manufacturing cost. In particular, the problem to be solved by the invention is that the supporting projections of the conventional viscous flow blower are equally spaced apart, and the levels of noise may suddenly sharply increase at certain frequencies possibly due to resonance in operation.

For achieving above and other objects, the invention provides a viscous flow blower comprising a housing including an inlet, an outlet, a motor, and an internal space; a seat being disposed in the housing and including a body, N supporting projections, a connection member, and an axis of rotation wherein N is an integer equal to or greater than five, the N supporting projections extending from the body, the connection member is coaxial with the axis of rotation, and the motor is operatively connected to the seat so that the seat is configured to rotate by activating the motor; and a plurality of annular blades stacked on the seat and being parallel to each other wherein each of the annular blades include a plurality of through holes with the supporting projections inserted through respectively; wherein the N supporting projections are spaced from the axis of rotation by a predetermine distance; an angle is formed by a first virtual line extending from one supporting projection to the axis of rotation and a second virtual line extending from an adjacent supporting projection to the axis of rotation so as to form N angles; the N angles all have different degrees; and the N angles form an arithmetic progression with a common difference.

The above and other objects, features and advantages of the invention will become apparent from the following detailed description taken with the accompanying drawings.

DETAILED DESCRIPTION OF THE INVENTION

Figure 1A:
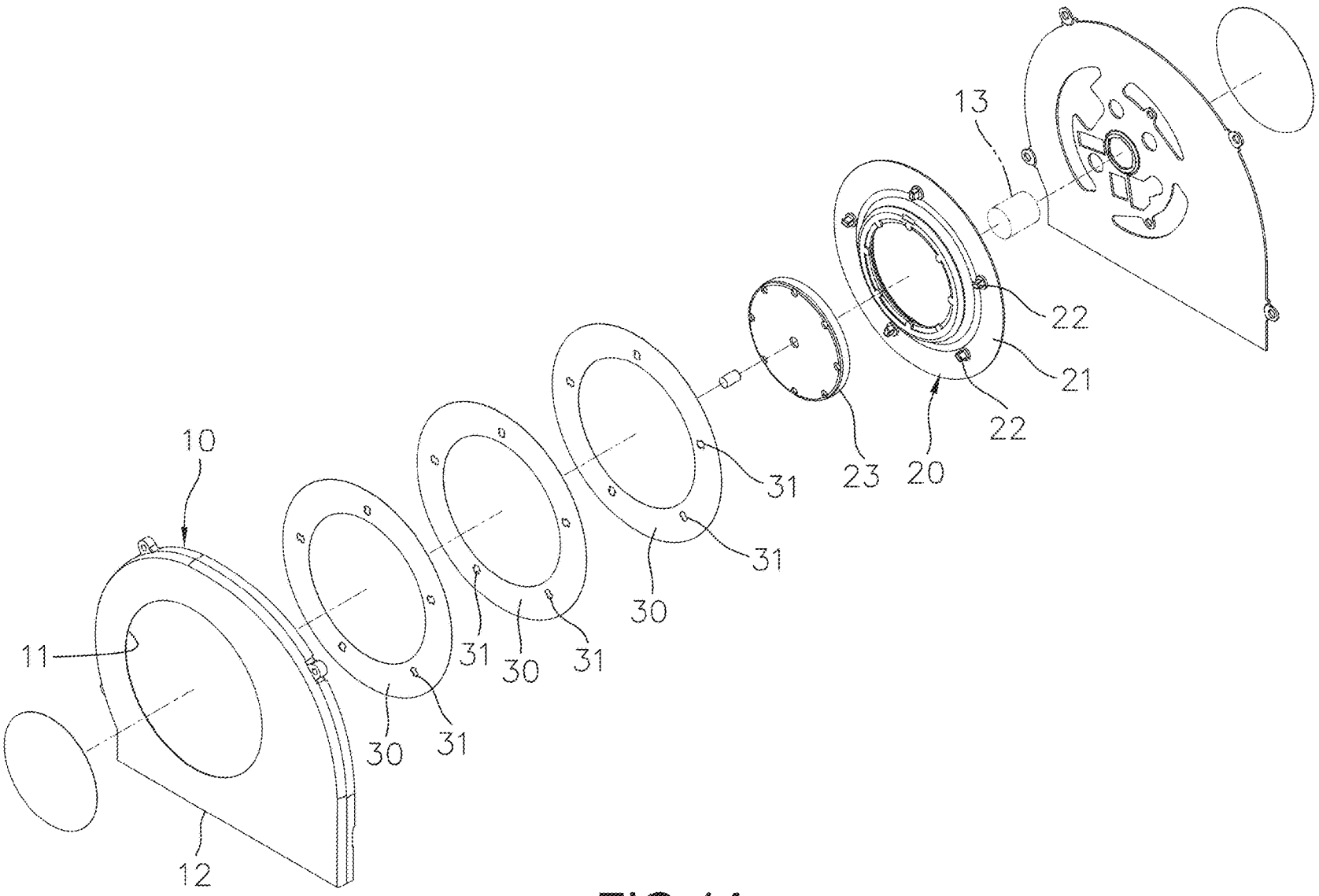
FIG. 1A is an exploded view of a viscous flow blower according to the invention.
Figure 1B:
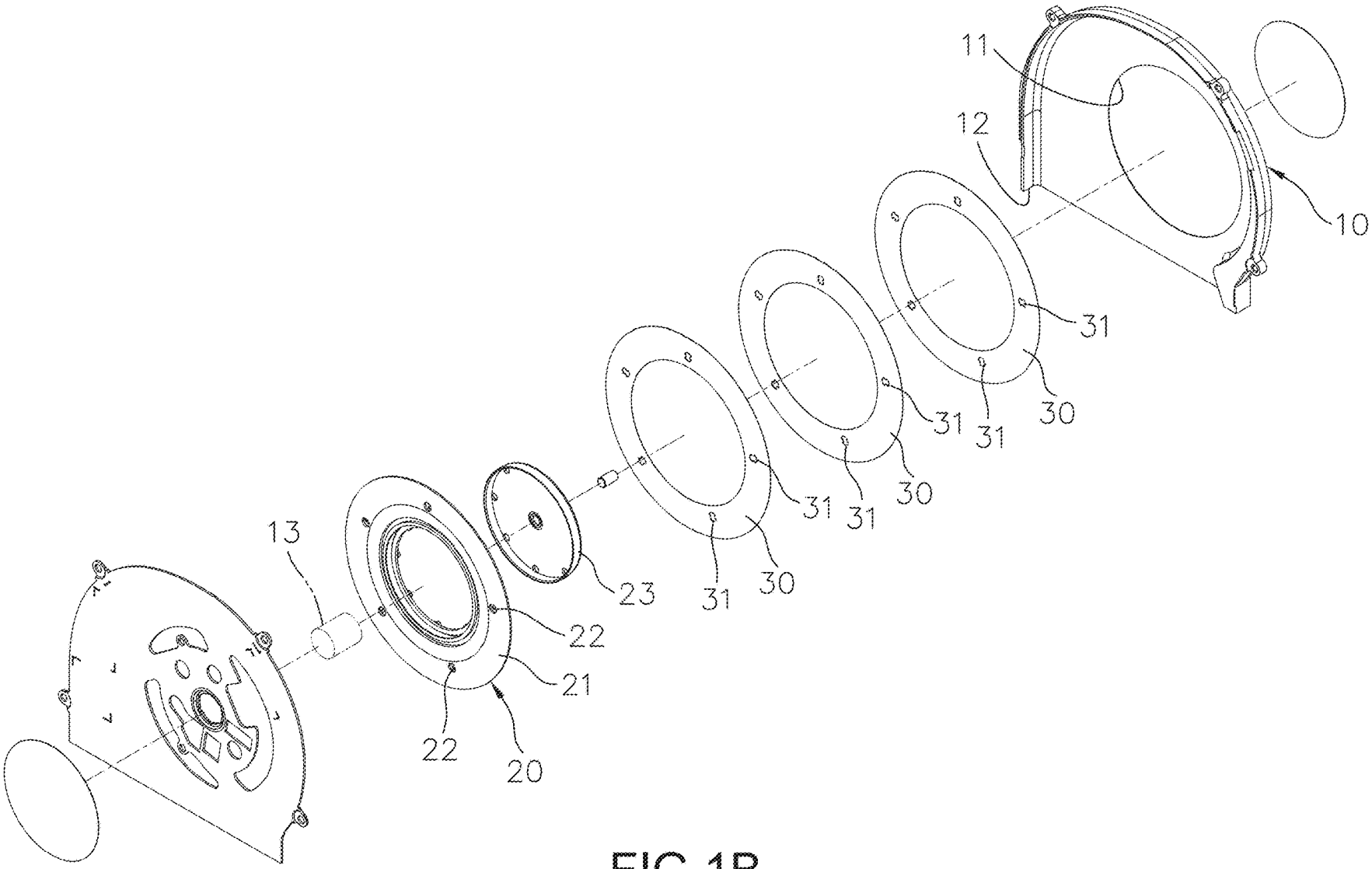
FIG. 1B is another exploded view of the viscous flow blower, viewed from an angle opposite to that in FIG. 1A.
Figure 2:
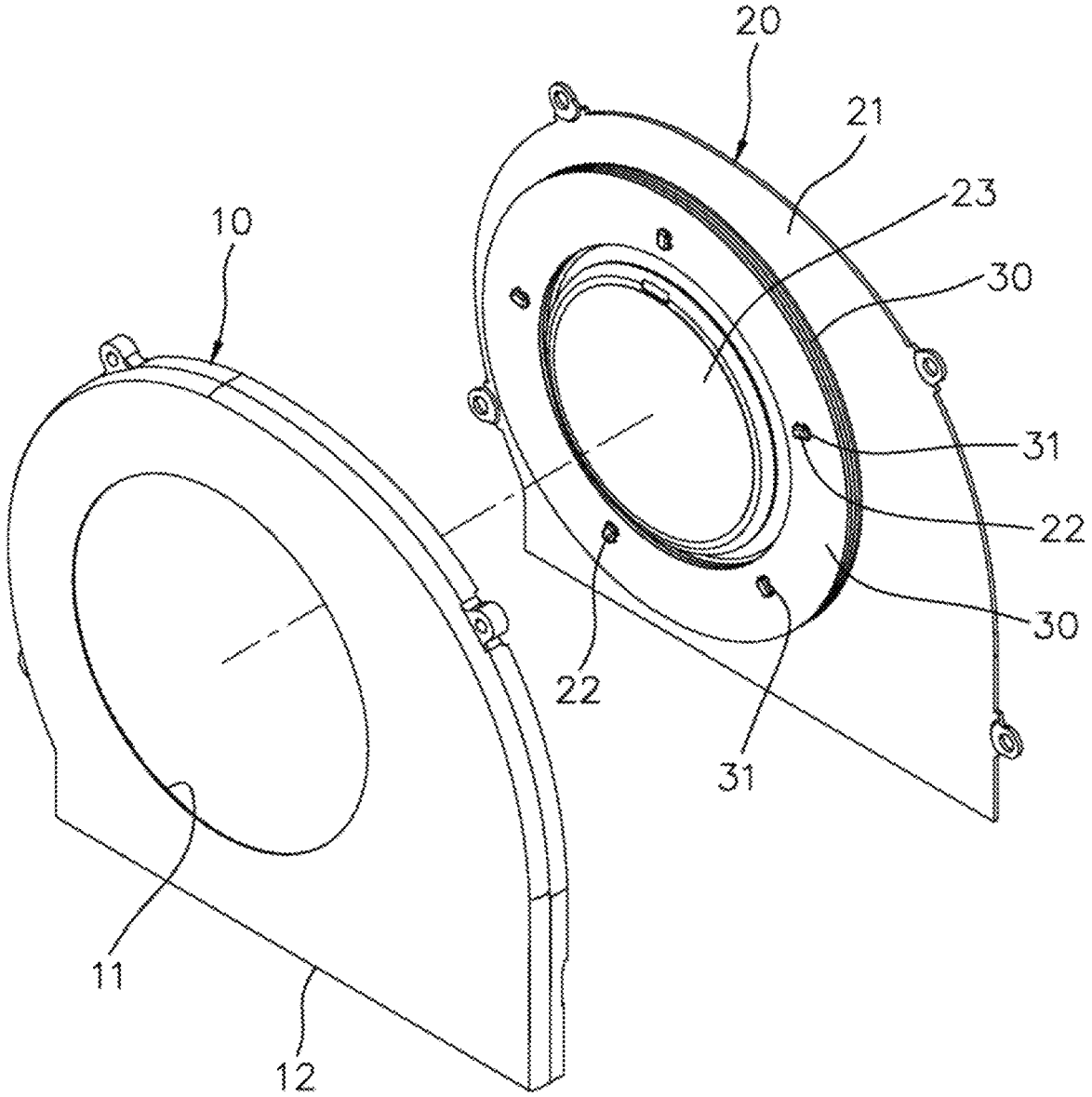
FIG. 2 is a perspective view of the partially assembled viscous flow blower.
Figure 3:
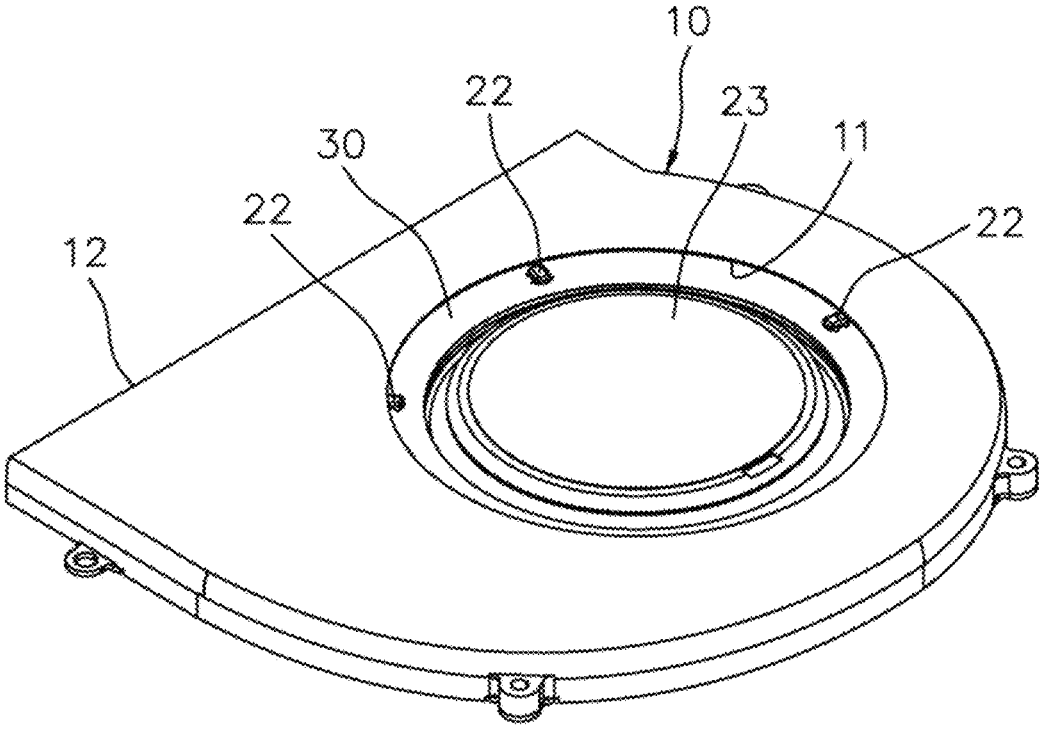
FIG. 3 is a perspective view of the assembled viscous flow blower.
Figure 4:
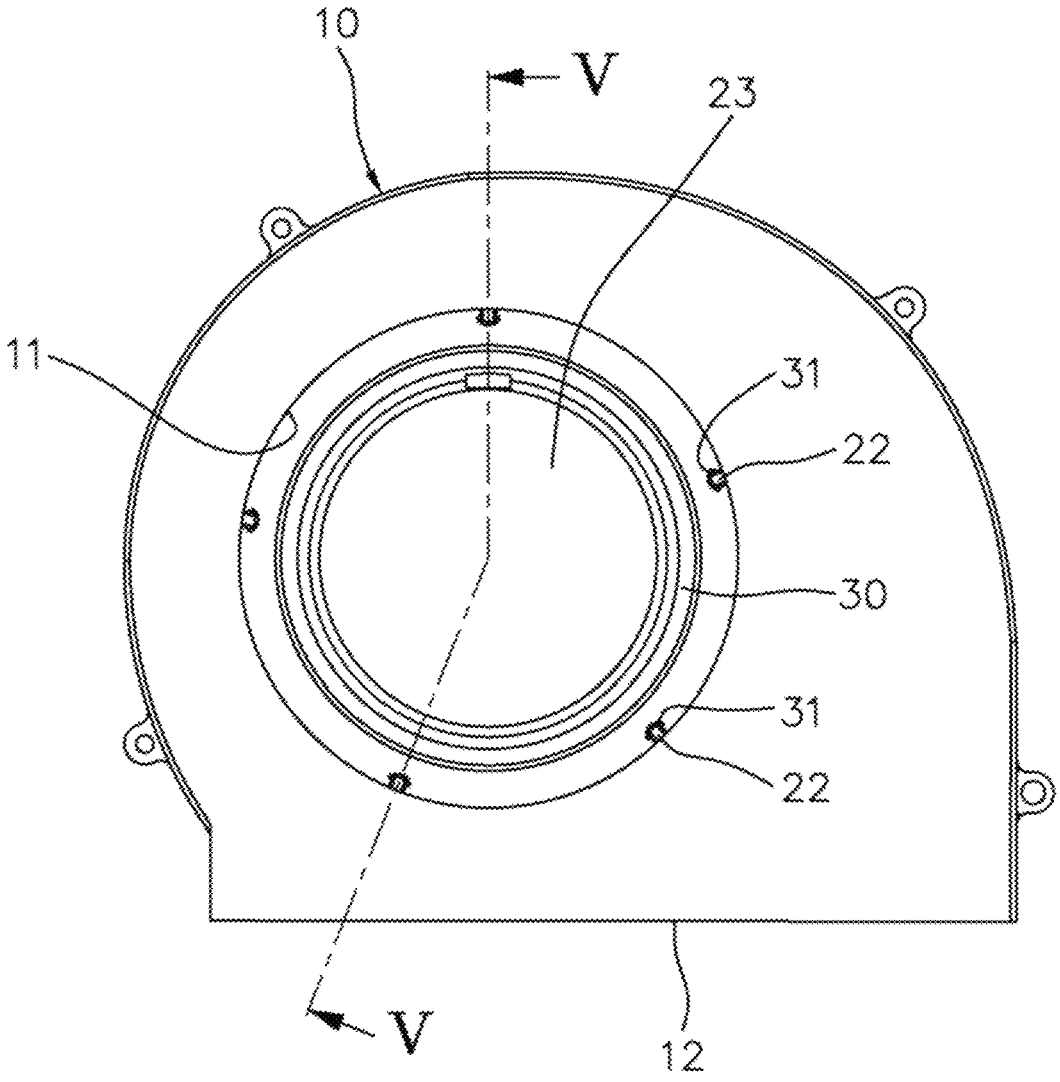
FIG. 4 is a front view of the viscous flow blower in FIG. 3.
Figure 5:
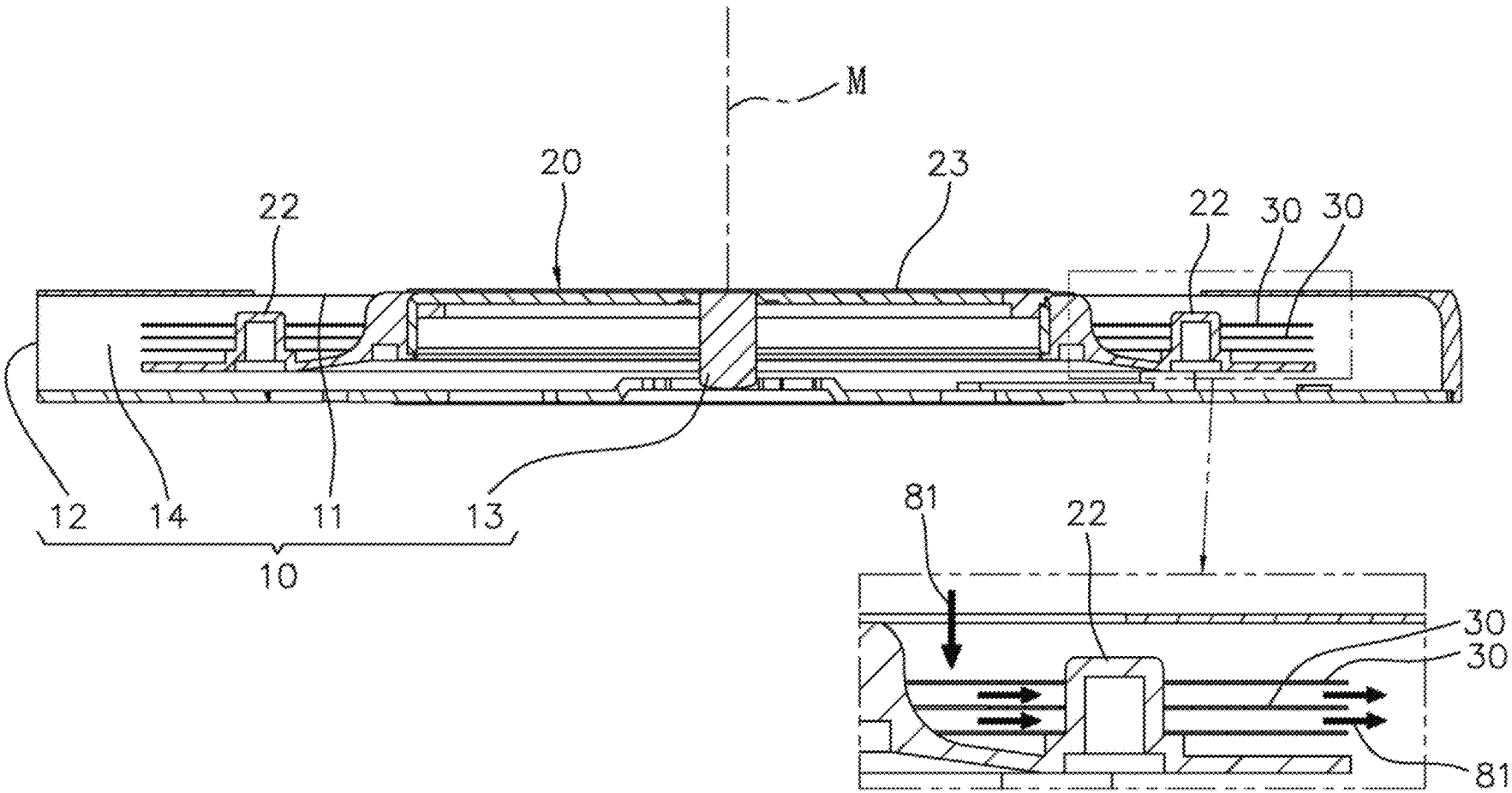
FIG. 5 is a sectional view taken along line V-V in FIG. 4.

Referring to FIGS. 1A to 6B, a viscous flow blower in accordance with the invention comprises the following components as discussed in detail below.

A housing 10 includes an inlet 11, an outlet 12, a motor 13, and an internal space 14.

A seat 20 is disposed in the housing 10 and includes a body 21, a plurality of (e.g., N) supporting projections 22, a connection member 23, and an axis of rotation M. N is an integer equal to or greater than five. The N supporting projections 22 extend from the body 21. The connection member 23 is coaxial with the axis of rotation M. The motor 13 is operatively connected to the seat 20 so that the seat 20 may rotate by activating the motor 13.

A plurality of annular blades 30 are stacked on the seat 20 and parallel to each other. Each annular blade 30 includes a plurality of through holes 31 with the supporting projections 22 inserted through respectively.

Figure 6A:
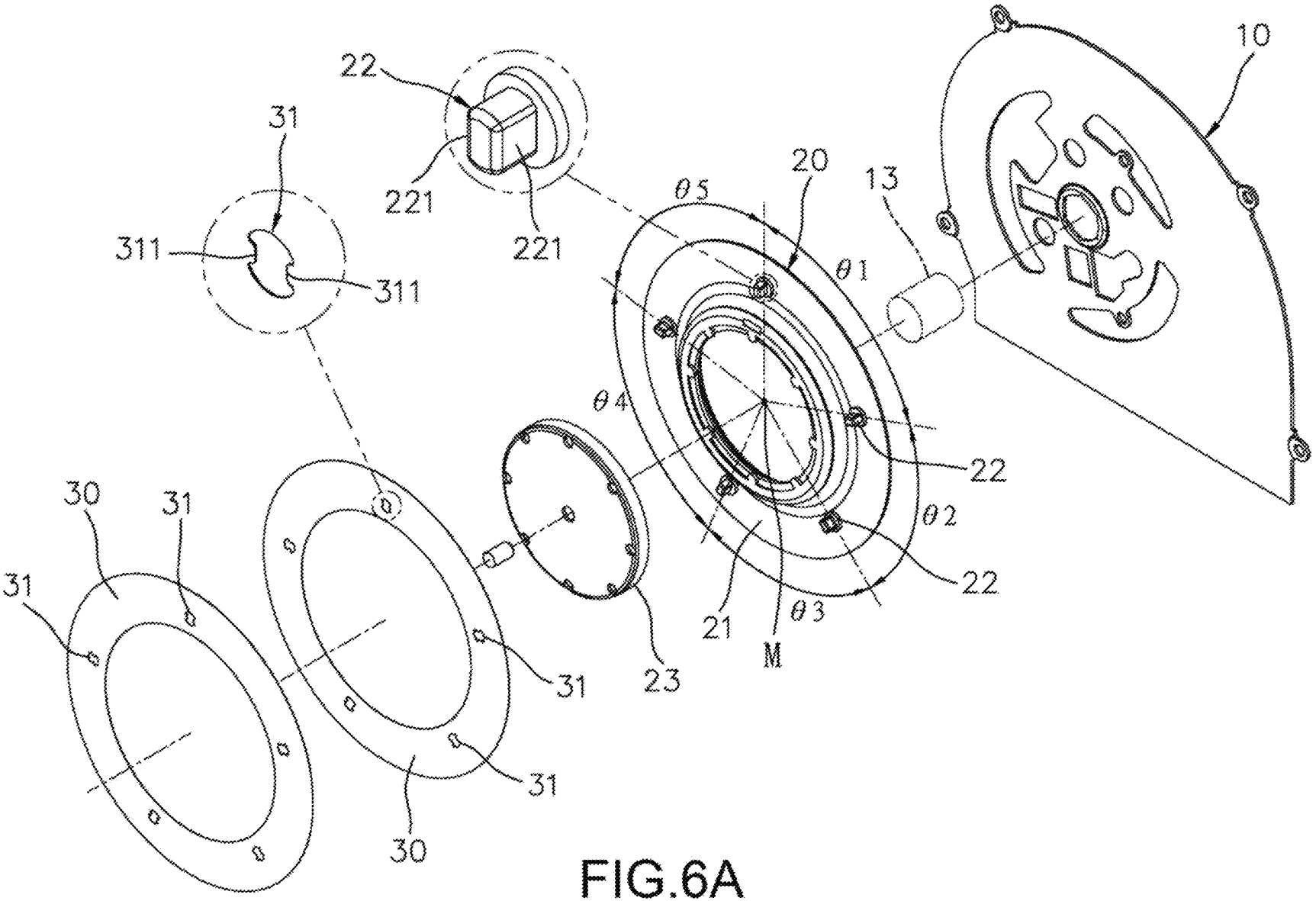
FIG. 6A is an exploded view of some components of the viscous flow blower showing a configuration of different angles.

The N supporting projections 22 are spaced from the axis of rotation M by a predetermine distance. An angle is formed by a first virtual line extending from one supporting projection 22 to the axis of rotation M (i.e., a common endpoint) and a second virtual line extending from an adjacent supporting projection 22 to the axis of rotation M. Thus, there are N angles each defined between two adjacent supporting projections 22. As shown in FIG. 6A, the angles include θ1, θ2, θ3, θ4 and θ5. It is noted that θ1, θ2, θ3, θ4 and θ5 have different degrees or only some of them have the same degree. Thus, suddenly sharp increases in amplitude of noise at certain frequencies can be reduced. As indicated by arrows in FIG. 5, air 81 enters the inlet 11, further passes through the internal space 14, further passes through gaps between the adjacent annular blades 30, and finally leaves the outlet 12.

Figure 6B:
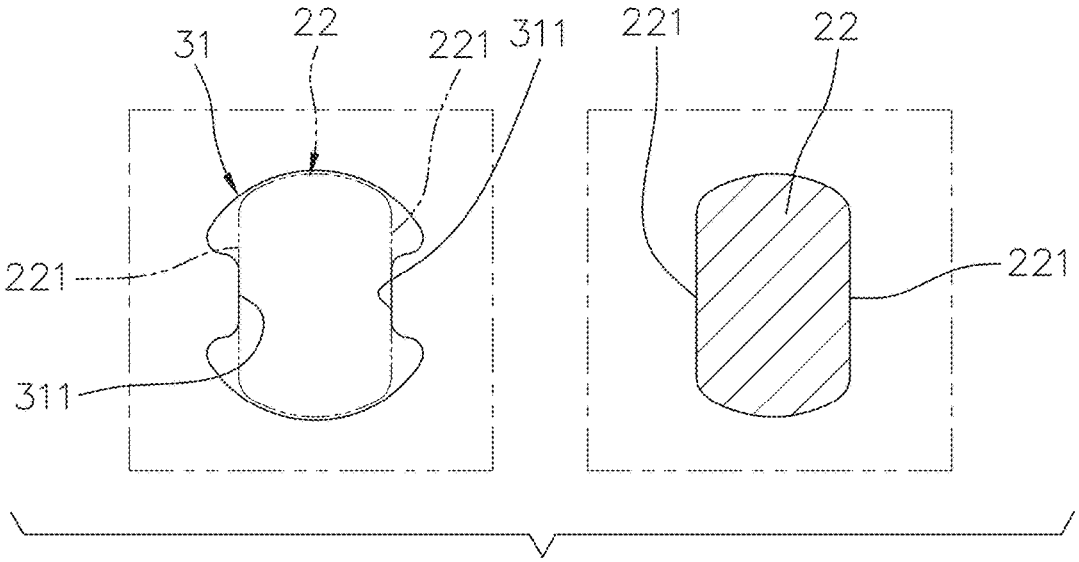
FIG. 6B schematically depicts a corresponding relationship of some components in FIG. 6A.

Preferably, as shown in FIG. 6B, each of the N supporting projections 22 have two parallel sides 221.

Preferably, the through holes 31 are configured to allow the supporting projections 22 to insert through respectively. Each of the through holes 31 have two opposite sides 311. The parallel sides 221 of the supporting projection 22 are clamped by the opposite sides 311 of the through hole 31 respectively. Thus, the supporting projection 22 is secured to the through hole 31.

If the N angles are different each other, one of the following applies: the N angles form an arithmetic progression with a common difference, and each of the N−1 angles are generated by a random process.

It is noted that regarding the conventional viscous flow blower, the supporting projections are equally spaced apart and peripheries of hollowed portions of the annular blades have the same length. However, the level of noise made by the conventional viscous flow blower is high in operation. Specifically, the levels of the noise may suddenly sharply increase at certain frequencies possibly due to, for example resonance. The high level of noise is not desired and the noise cannot be controlled.

For solving problems associated with the conventional viscous flow blower, the invention is envisaged that the N angles all have different degrees or only some of them have the same degree. Thus, it is possible to reduce suddenly sharp increases in amplitude of noise at certain frequencies when the annular blades 30 rotate.

Comparison results of the viscous flow blowers of four embodiments of the invention and the conventional viscous flow blower are tabulated in the following table:

| items | angles formed by supporting projections (degrees) | suddenly sharp increase in amplitude of noise at certain frequencies |
|---|---|---|
| the conventional viscous flow blower | 72, 72, 72, 72, 72 | yes |
| first embodiment of the invention | 70, 71, 72, 73, 74 | no |
| second embodiment of the invention | 71, 71.5, 72, 72.5, 73 | no |
| third embodiment of the invention | 70.3, 72.6, 72.1, 71.9, 73.1 | no |
| fourth embodiment of the invention | 72, 72, 71.3, 72.2, 72.5 | no |

Regarding the first embodiment of the invention, the angles formed by the supporting projections 22 are 70, 71, 72, 73, and 74 degrees. That is, 72 degrees is the median separating the lower half from the higher half of the angles. The five angles form an arithmetic progression with a common difference of 1. As a result, θ1 is 70 degrees, θ2 is 71 degrees, θ3 is 72 degrees, θ4 is 73 degrees, and θ5 is 74 degrees.

Regarding the second embodiment of the invention, the angles formed by the supporting projections 22 are 71, 71.5, 72, 72.5, and 73 degrees. That is, 72 degrees is the median separating the lower half from the higher half of the angles. The five angles form an arithmetic progression with a common difference of 0.5. As a result, θ1 is 71 degrees, θ2 is 71.5 degrees, θ3 is 72 degrees, θ4 is 72.5 degrees, and θ5 is 73 degrees.

Regarding the third embodiment of the invention, degrees of four (N−1) of the five (N) angles formed by the supporting projections 22 are generated by a random process and degrees of the four angles are between 70 degrees and 74 degrees. For example, θ1 is 70.3 degrees, θ2 is 72.6 degrees, θ3 is 72.1 degrees, and θ4 is 71.9 degrees. θ5 can be obtained by subtracting a sum of 70.3, 72.6, 72.1, and 71.9 from 360 and the result is 73.1. In other words, N−1 different values (i.e., degrees) are generated by a random process, the N−1 different values are summed, the sum is subtracted from 360, and the result is the value of Nth angle. It is found by the present inventor that the N−1 values generated by a random process and the Nth value obtained from the N−1 values of the third embodiment of the invention can prevent resonance from been generated by N angles of the same value. Thus, the third embodiment of the invention is more advantageous than both the first and second embodiments of the invention.

Regarding the fourth embodiment of the invention, degrees of some of the angles formed by the supporting projections 22 are different. For example, θ 1 is 72 degrees and θ2 is also 72 degrees, both θ3 and θ4 are generated by a random process, and θ3 is 71.3 degrees and θ4 is 72.2 degrees respectively. Similar to the third embodiment, θ5 can be obtained by subtracting a sum of 72, 72, 71.3, and 72.2 from 360 and the result is 72.5. In other words, some angles are the same, some angles are different, and value of the Nth angle can be obtained by subtracting the sum of the values of N−1 angles from 360. It is found by the present inventor that some angles are the same and some angles are different of the fourth embodiment can also prevent resonance from been generated by N angles of the same value. Thus, the fourth embodiment of the invention is more advantageous than the conventional viscous flow blower.

It is noted that the configuration of some angles is the same and some angles are different of the fourth embodiment is made possible when the number of the angles being different is more than half of the angles. For example, when N is equal to five, there are three (i.e., greater than 2.5) different angles and the remaining two angles are the same. Also, when N is equal to seven, there are three (i.e., less than 3.5) angles are the same and the remaining four angles are different. In short, the number of the angles being different is greater than that of the angles being the same in order to prevent resonance from being generated.

It is noted that the number or values mentioned in the four embodiments are for description only and for non-limiting purposes.

In the third embodiment of the invention, preferably, the random numbers of the angles are in the range of the median±2.78%. For example, when N is equal to five, the median is 72 obtained by dividing 360 by 5 and an angle of 72±2 degrees have a good result.

Figure 7:
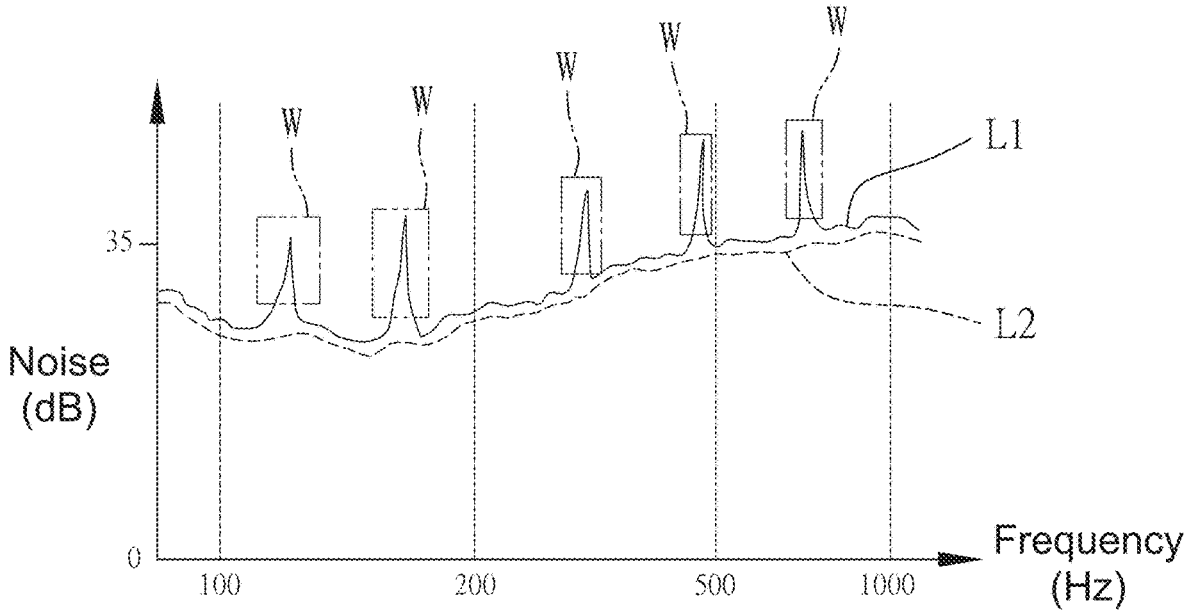
FIG. 7 plots noise versus frequency for the viscous flow blower of a third embodiment of the invention and the conventional viscous flow blower.
Figure 8:
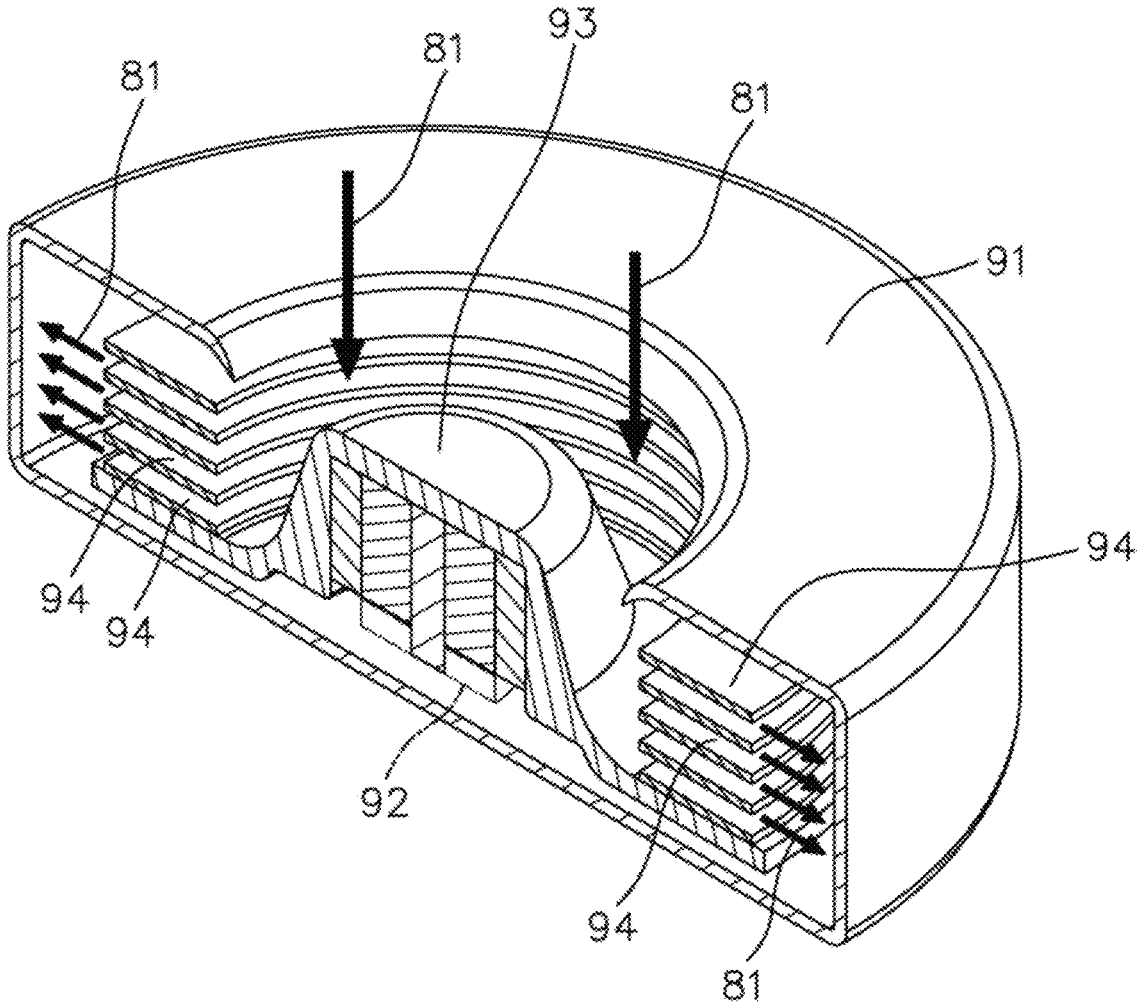
FIG.8 (PRIOR ART)
FIG. 8 is longitudinal sectional of a conventional viscous flow blower.
Figure 9:
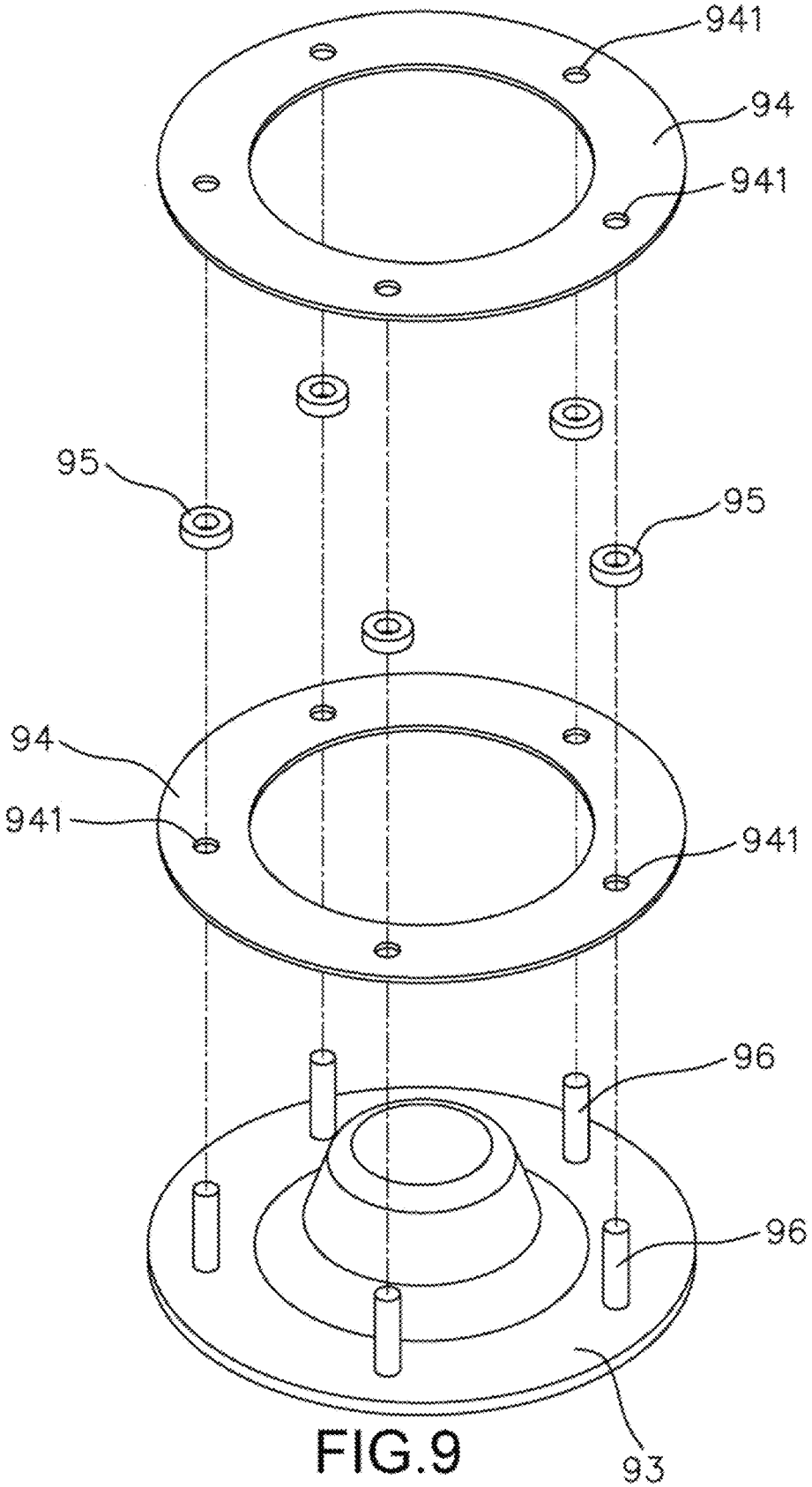
FIG.9 (PRIOR ART)
FIG. 9 is an exploded view of some components of the conventional viscous flow blower showing its corresponding relationship.
Figure 10:
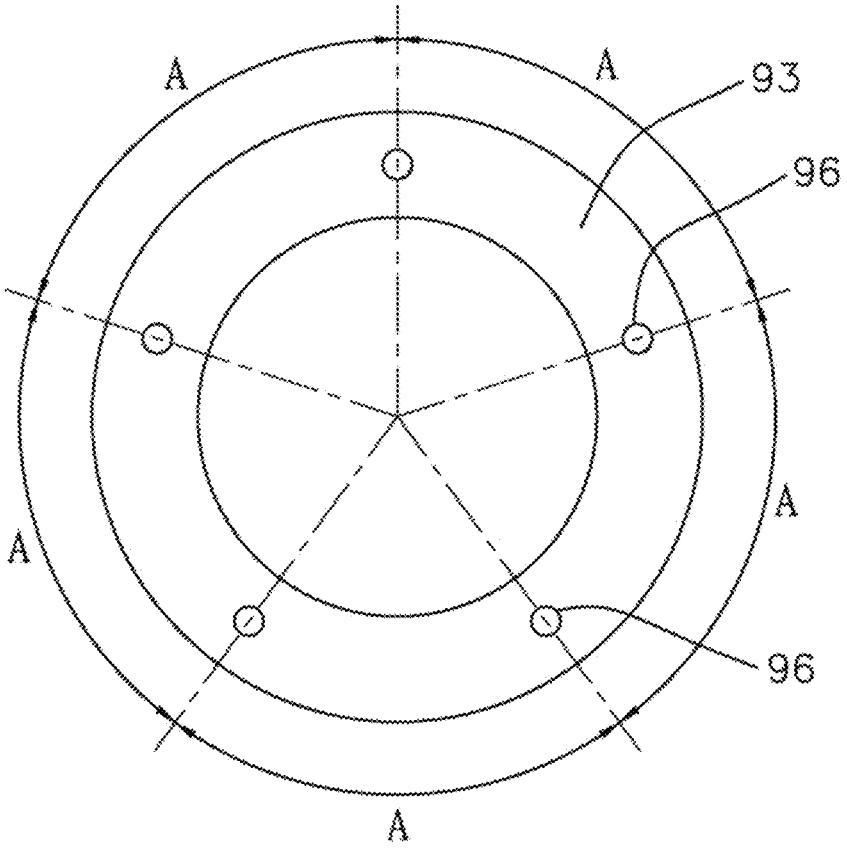
FIG.10 (PRIOR ART)
FIG. 10 is a bottom view of the impeller in FIG. 9 showing a configuration of same angles.

Referring to FIG. 7, it plots noise (in vertical axis) versus frequency (in horizontal axis) for the conventional viscous flow blower L1 and the viscous flow blower of the third embodiment of the invention L2. As shown, there are five spike zones W each having a suddenly sharp increase in amplitude of noise between frequencies 100 Hz and 1000 Hz for L1 and there are no such spike zones between the same frequency range for L2. Thus, the invention can control noise to a desired low level in operation. It is concluded that the viscous flow blower of the invention is an improvement of the conventional viscous flow blower.

The invention has the following advantages and benefits in comparison with the conventional art:

The different angles formed by the supporting projections can reduce a suddenly sharp increase in amplitude of noise in operation. The N angles formed by the N supporting projections are all different or some are different. It is possible to reduce suddenly sharp increases in amplitude of noise at certain frequencies possibly due to resonance when the annular blades rotate. Thus, the different angles formed by the supporting projections can reduce suddenly sharp increases in amplitude of noise in operation.

It is easy to implement and has a low manufacturing cost. Positions of the N supporting projections on the body of the seat are adjusted. The N supporting projections are inserted into the through holes of the annular blade to be fastened together. Thus, it is easy to implement for those skilled in the art. It has a low manufacturing cost.

While the invention has been described in terms of preferred embodiments, those skilled in the art will recognize that the invention can be practiced with modifications within the scope of the appended claims.

What is claimed is:

1. A viscous flow blower, comprising:

a housing including an inlet, an outlet, a motor, and an internal space;

a seat being disposed in the housing and including a body, N supporting projections, a connection member, and an axis of rotation wherein N is an integer equal to or greater than five, the N supporting projections extending from the body, the connection member is coaxial with the axis of rotation, and the motor is operatively connected to the seat so that the seat is configured to rotate by activating the motor; and a plurality of annular blades stacked on the seat and being parallel to each other wherein each of the annular blades include a plurality of through holes with the supporting projections inserted through respectively;

wherein the N supporting projections are spaced from the axis of rotation by a predetermine distance; an angle is formed by a first virtual line extending from one supporting projection to the axis of rotation and a second virtual line extending from an adjacent supporting projection to the axis of rotation so as to form N angles; the N angles all have different degrees; and the N angles form an arithmetic progression with a common difference.

2. The viscous flow blower of claim 1, wherein each of the N supporting projections have two parallel sides; the N supporting projections are configured to insert through the through holes respectively; each of the through holes have two opposite sides; and the parallel sides of the supporting projection are clamped by the opposite sides of the through hole respectively.

3. The viscous flow blower of claim 1, wherein the number of the angles is five, and the five angles are 70 degrees, 71 degrees, 72 degrees, 73 degrees, and 74 degrees respectively.

4. The viscous flow blower of claim 1, wherein the number of the angles is five, and the five angles are 71 degrees, 71.5 degrees, 72 degrees, 72.5 degrees, and 73 degrees respectively.

* * * * *